United States Patent [19]

Watts

[11] Patent Number: 4,872,294

[45] Date of Patent: Oct. 10, 1989

[54] BAR AND COIL DESCALERS

[76] Inventor: W. David Watts, 4965 Hwy. 19 N., Alpharetta, Ga. 30201

[21] Appl. No.: 42,464

[22] Filed: Apr. 24, 1987

Related U.S. Application Data

[63] Continuation-in-part of Ser. No. 824,460, Jan. 31, 1986, abandoned.

[51] Int. Cl.[4] ..... B24C 3/14

[52] U.S. Cl. ..... 51/420; 51/426; 51/431

[58] Field of Search ..... 51/417, 419, 420, 18, 51/20, 426, 418, 424, 425, 5 R, 428, 431, 413

[56] References Cited

U.S. PATENT DOCUMENTS

| | | | |
|---|---|---|---|
| 1,568,958 | 1/1926 | Carter | 51/420 |
| 2,037,047 | 4/1936 | Rosenberger | 51/417 |
| 2,118,832 | 5/1938 | Wean | 51/417 |
| 2,337,048 | 12/1943 | Huyett | 51/426 |
| 3,160,991 | 12/1964 | Bradley | 51/426 |
| 4,326,362 | 4/1982 | Williams | 51/424 |

FOREIGN PATENT DOCUMENTS

| | | | |
|---|---|---|---|
| 10610 | of 1904 | United Kingdom | 51/417 |

*Primary Examiner*—Robert Rose
*Attorney, Agent, or Firm*—William Nitkin

[57] ABSTRACT

A bar and/or coil descaling device having a first chamber for entry of the workpiece therein with dual shotblast machines propelling particles thereagainst on opposite sides of the workpiece with a second chamber into which the bar is passed with dual shotblast machines therein to propel particles on opposite sides of the workpiece, with some embodiments having a shot and debris removal system for any shot or debris left on top of the workpiece, the cleaned workpiece to be then passed out of the device.

1 Claim, 6 Drawing Sheets

BAR AND COIL DESCALERS

This application is a continuation-in-part of my previous application for a Bar Descaler filed Jan. 31, 1986, Ser. No. 824,460, now abandoned.

BACKGROUND OF THE INVENTION

1. Field of the Invention

The apparatus of this invention resides in the area of bar descalers and coil descalers and more particularly relates to blast machines which propel particulate materials at reinforcement bars (rebars) or other cylindrical items and in another embodiment against wide sheet metals in order to clean them so that they are in suitable condition for further processing such as the application of coatings and the like.

2. Description of the Prior Art

Rod material such as reinforcement bars commonly called rebars frequently require cleaning and descaling to remove oxide particles caused by rust or other substances that may be formed or caked thereon. Such cleaning is frequently mandated by the laws of various communities where, for example, rebars are used in concrete road and bridge construction. It has been found that when uncoated reinforcement bars are used in road and bridge construction and the roadway cracks, salt water will seep in and electrolysis will take place causing the rebars to rust, weaken, decompose and precipitate premature deterioration of the roadway or bridge. To avoid such deterioration, various states have created laws requiring that rebars must be coated with a water-impervious material that will prevent them from rusting. In order to coat the rebars, the rebars must be first cleaned which is usually accomplished by shot-blast techniques where the rebar is struck by shot propelled at high speed against the rebar thereby cleaning the bar.

In the prior art to accomplish such cleaning, rebars are usually conveyed through a shot-blast machine on V-groove rollers. Such machines are frequently approximately 20 ft in length and require a pit thereunder of approximately 8 feet in depth. Such blast machines frequently present problems in that the rebars, being carried on the V-groove rollers of the conveyor which moves them through the blasting area where shot is propelled against the bars, will tangle from time to time requiring the shutting down of the machinery and time-consuming and expensive cutting up of the bars to remove the tangled bars from the machinery. Such machines are also costly to maintain and require substantial parts replacement since the shot that is propelled against the rebars carried on the V-groove conveyor rollers also hits the conveyor rollers and gradually destroys the conveyor roller assembly which must then be replaced, requiring shutting down of the assembly. Further, the 8 ft pit that is required for prior art machinery is costly to dig and incorporate into production lines.

In another embodiment of the prior art, machines have been utilized to clean sheet metal which usually comes in coils and is descaled by delivering it on conveyors through long machines which have shotblast wheels disposed above and below the sheet metal being cleaned. Such machines usually have a plurality of shot-blast machines disposed in a large long chamber through which the sheet steel is delivered wherein each shot blast machine cleans a specific portion of the upper or lower surface of the sheet steel. Some of the prior art cleaning machines have the lower blast wheels disposed at 45 degree angles to the steel sheets being cleaned. When cleaning sheet material, two problems have arisen. The first is that the shot tends to accumulate on top of the sheet as it passes through the cleaning chamber, the chambers being as long as 20 feet and this accumulation can create a considerable problem at the time the sheet steel exits the chamber for further processing. The second problem is deformation or warping of the sheets caused by the blast machines of the prior art in that they have hot spots in their blast pattern which unequal blast intensity causes such deformation. In the prior art to remove the shot from the top of the sheet, two methods have generally been utilized. The first method incorporates a series of brushes that sweep horizontally to the side to try to brush the shot material off the sheet steel but in some cases this method has been found insufficient and the shot will pass out of the chamber on the top of the steel which occurrence is undesirable. Another method which has been used provides blowers at the exit of the chamber, blowing back into the chamber parallel to the direction of the workpiece flow to try to blow the shot off the top of the steel, but this method has also proven to be less than one hundred percent effective in that many times more shot will be deposited and left on top of the steel sheet than the blowers can effectively remove.

SUMMARY OF THE INVENTION

The system of my invention described herein is an improved cleaning system for bars such as rebars or other cylindrical structures and in another embodiment for sheet metals. The cylindrical structures that can be cleaned vary in diameter from $\frac{3}{8}$ inch to 3 inches or more, and in such mode the system of this invention uses neither a roller conveyor nor any other type of material handling system inside the blast area so that the system of this invention is not worn out by the process of shot-blast cleaning. Further the machine of this invention does not require a deep pit for operation and can be disposed on a conveyor line which enters the bars into the machine with another conveyor line receiving the bars as they exit from the machine.

The apparatus of this invention is approximately 4 ft in depth through which the bars or sheets of the work flow are moved. The device has an outer casing and a centrally disposed wall dividing the outer casing into two chambers. In the first wall is disposed a workpiece opening which can be an elongated slot, a bar guide tube or a plurality of bar guide tubes arrayed in parallel fashion. The elongated slot can receive sheet metal in wide planar sheets which can be delivered from coils. In the embodiment for cleaning bars each bar guide tube can accept a bar and the machine can frequently run between 1–12 bars side by side but more bars can be accommodated depending upon how many bar guide tubes are utilized. The bar guide tubes each receive a bar and have a square funnel shape larger than the diameter of the bar. Each bar guide tube is approximately 12 inches long and extends approximately 6 inches outside and inside the first outer wall. The bars are carried by conventional conveyors or V-grooved conveyor rollers up to the device of this invention and the bar guide tubes must be in a line with the conveyors carrying the work flow. A recess in some cases of approximately 1 foot in depth may be required so that the bar guide tubes are aligned with the work flow of the bars although in some constructions the design of this unit can be accomplished without requiring a pit if the bar guide tubes are disposed at the same height as the work flow carried by the conveyors, each conveyor pushing the bar into a bar guide tube. Each bar is moved into a bar guide tube because of the force of the conveyor on which it is carried. Once the bar has started through the bar guide tube, it passes into the first chamber. Around this chamber are disposed two shot blast wheels such as the Blastec 24 inch diameter, 3-inch wide blade wheel. The wheels are disposed on opposite sides of the outer casing at 45 degree angles above and below the rebars. This angle appears when looking from an end view that each shot blast machine is disposed along the sides of a diamond shape casing with the first wheel on the upper portion directing its shot downward. The width of the shot blast of the wheels is approximately 4 inches and one must use a wheel with a narrow shot blast pattern. The second wheel shoots upwards from the opposite side of the diamond shape casing from the first wheel and also has a similar narrow blast pattern, but the second wheel is offset approximately 4 inches from the first wheel so that the blast patterns do not coincide leaving a 4-inch air space therebetween. The first wheel blasts downward onto the bar, cleaning the section of the bar that is exposed to that wheel. The second wheel, being disposed further back in the machine near the dividing wall, blasts upward and hits the bar on the part exposed to the blast area of that wheel. In this way the shot of the blast wheel does not hit the other wheel causing it damage or fall back down into the wheel as might otherwise occur if the wheel were aimed straight upwards. The range of the shot blast, being narrow, causes the shot to fly against the bar, strike the bar, and any shot which misses the bar hits the casing and then falls downward to the central portion of the base of the casing where a collecting auger operates to move fallen shot along to a return mechanism which will be described in further detail below. Once the bar moves along past the second shotblaster, it enters a second bar guide tube disposed in the central wall of the casing of the device.

The bar enters the second bar guide tube directly as the short 12-inch blast space does not allow the bar to be significantly bent. The opposing blast patterns also tend to keep the bar on a level path with the upwards blast of the second wheel tending to lift the bar if deflected downward at all by its weight or the shot blast of the first wheel so that it can enter the second funnel-shaped bar guide tube without further direction. The second bar guide tube which is approximately 12 inches long and extends 6 inches into the first chamber and 6 inches into the second chamber carries the bar which is still being pushed by the force of the conveyor system into the second chamber. Once the bar is within the second chamber, a third shotblast machine shoots downward at a 45 degree angle being approximately 90 degrees to the position of the first shotblast machine in the casing. The fourth shotblast machine, being positioned approximately 4 inches beyond the third shot blast machine, directs shot upwards opposite the third shotblast machine to clean the bar from that position. At this point the bar has been struck from four opposite sides by four shotblast machines and the blast patterns within the second chamber as in the first chamber do not coincide with one another so that the wheels are not struck by the shot of the other machines and the shot falls to the auger collecting mechanism below. The bar then passes into a third funnel-entranced bar guide tube located in the outer rear wall of the casing which directs it out of the chamber. The bar is continued to be forced because of the action of the first conveyor still pushing the rear part of the bar into the machine, onto the removal conveyor where the bar then is picked up by the removal conveyor which then pulls the bar now extending through the machine as the conveyor on the front part of the bar pushes it. When the end of the bar leaves the front conveyor, the bar continues to be pulled by the rear conveyor system which removes the bar from the casing. Once cleaned the bar can be coated with paint or other plastic-like water-impervious material to prevent it from rusting or equivalent treatment.

In another embodiment the device of this invention can be used to clean alloy steel sheet or other sheet metals or materials that are provided and unrolled from coils. For such usage the chamber structure is very similar to that utilized to clean the bar materials as described above, one major difference being that instead of bar guide tubes, an elongated slot is provided at the vestibule at the entrance of the first chamber and a similar elongated slot is provided in the wall between the first and second chambers and at the exit of the second chamber. The chambers are of similar size to the chambers of the bar cleaning machine which prevents the steel from deflecting downward from the force of gravity or shot so that the steel sheet will pass without interference into the next slot. The slots can have open-flared mouths to help receive the sheet steel and a plurality of rollers can be utilized to help feed the steel material into the device and to exit from the device. The arrangement of the shotblast wheels is also similar to the arrangement found in the bar cleaning embodiment, but shot blast wheels can be provided with their blast pattern covering the full surface of the steel sheet so that the full shotblast pattern of the first and second shotblast wheels will cover the entire top and bottom and this full coverage will repeat when the steel goes into the second chamber. This full coverage avoids the hot spots and resulting sheet deformation of the prior art. A vestibule can be provided before the entrance of the first slot which vestibule helps prevent the escape of any shot out the front of the device and nylon brushes can be disposed at the front of the vestibule to further retain shot within the device. In some embodiments, only the first and second blast wheels need be utilized for full cleaning of the sheets at low production rates.

A new shot and debris remover is utilized in the sheet cleaning embodiment which removes any shot left on top of the sheet and also any debris from the cleaning process such as dust or other particles that have been removed from the surface being descaled. This removal is accomplished in the removal chamber which is provided after the second chamber in which a blast of air disposed from the side of the sheet being cleaned is provided as the sheet passes thereby. This air blast on one side is provided within a narrow chamber approximately 2–5 inches in depth and blows the shot across the surface of the sheet steel. At the other end of this chamber is a suction apparatus which provides suction of greater force than the force of the blowing and this suction completely eliminates and removes all shot and debris from the sheet steel as it passes through the chamber. The suction apparatus directs all the removed shot and debris to an expansion chamber where there is an upward draft caused by the suction from the dust collector which dust collectors are known in the art. The expansion chamber allows the shot to fall to the bottom by gravity but yet lifts the particles and other light debris upwards to the dust collector. Thus the debris is separated from the shot and the shot is cleaned to be recycled through the device.

As mentioned above, located at the bottom of the device is an auger system which carries the spent shot to a lift mechanism which carries it upwards by an elevator system which passes it through a chute back down pipes into the shot blast machines. Such circulation is necessary to recycle the shot so that it can be used over again.

BRIEF DESCRIPTION OF THE DRAWINGS

FIG. 3 illustrates an end view of the device of this invention with an elongated slot to receive sheet stock from rolls and the like.

DESCRIPTION OF THE PREFERRED EMBODIMENT(S)

Figure 1:
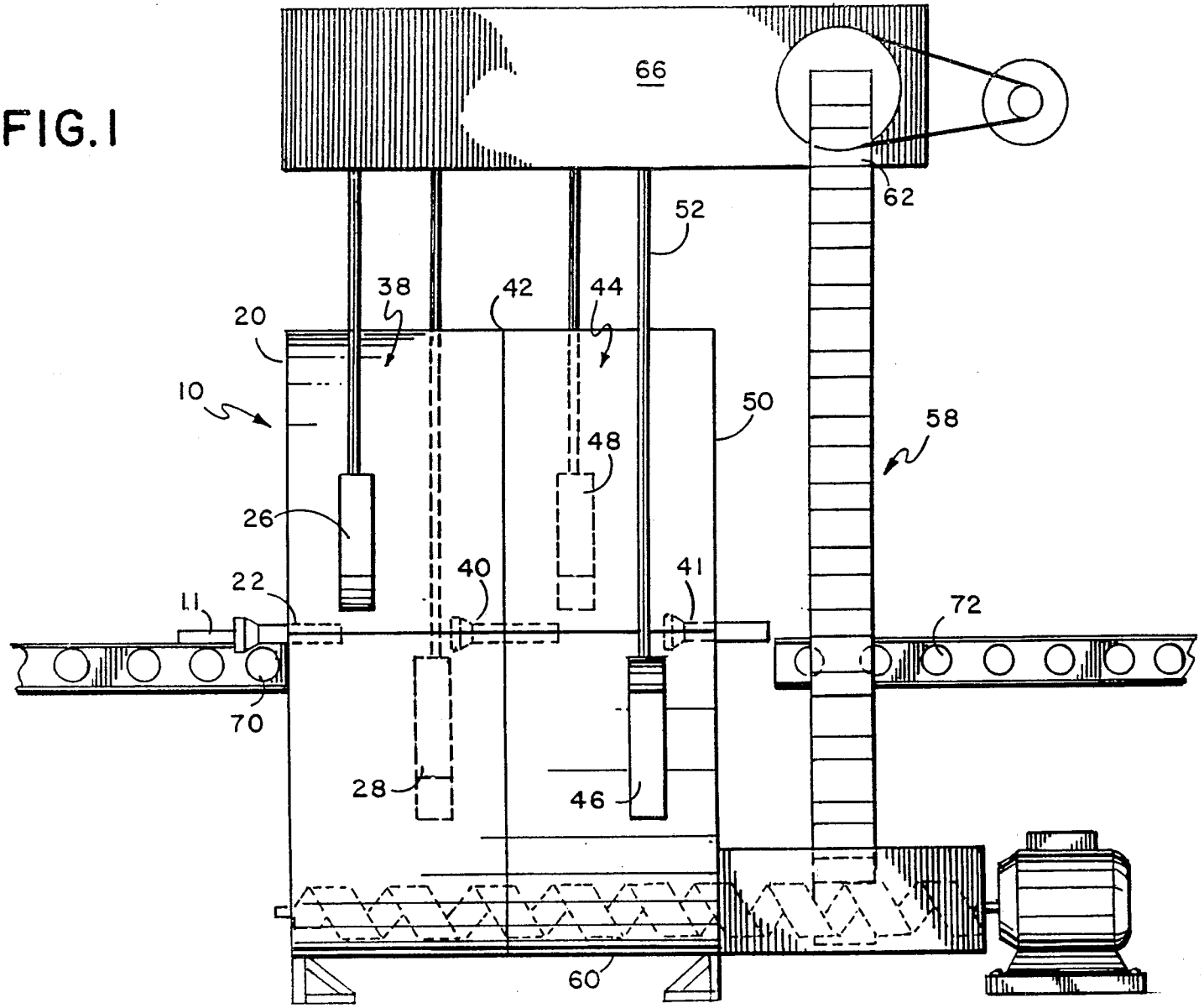
FIG. 1 illustrates a side perspective view of the device of this invention.
Figure 2:
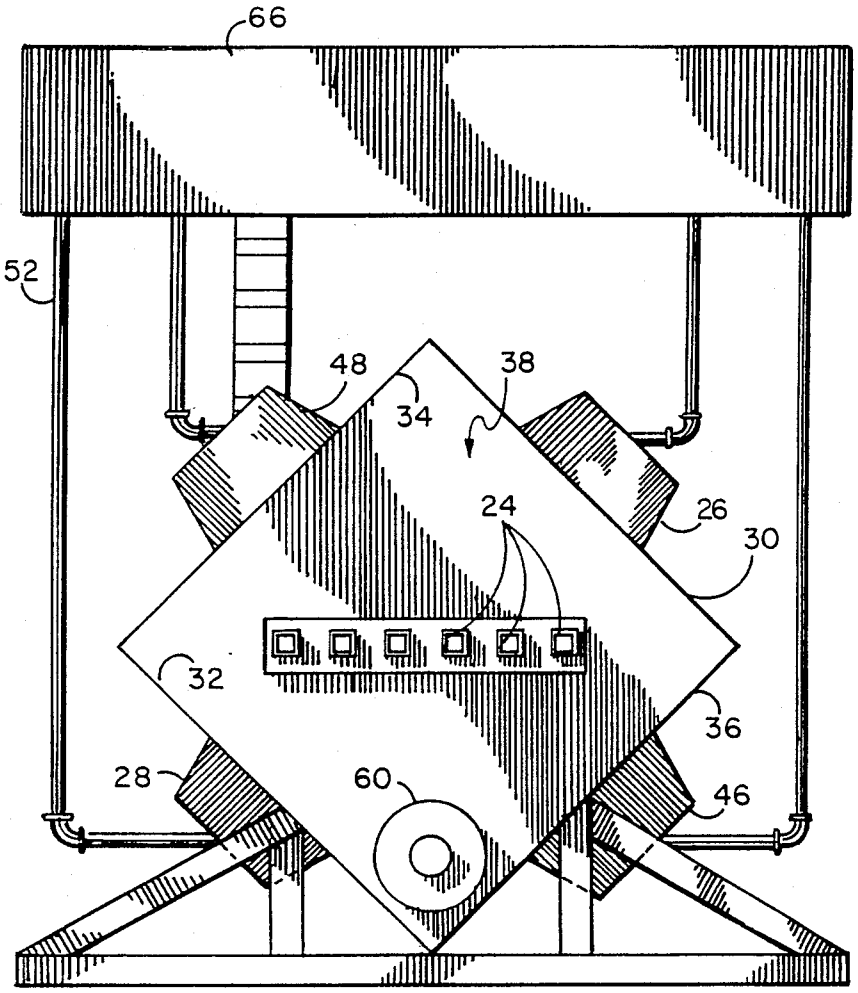
FIG. 2 illustrates an end view of the device of this invention.

FIG. 1 illustrates a side view of the device for cleaning bar stock of this invention when it is positioned in a conveyor line, the conveyor line being part of the plant and not part of the device of this invention. Front conveyor 70 leads to the device of this invention and rear conveyor 72 leads away from the device of this invention. Bars 11 are carried along the front conveyor in the conventional fashion up to device 10 of this invention where disposed within front wall 20 of the device of this invention is at least one bar guide tube 22 which is in line with the movement of bar 11 as it is carried on front conveyor 70 so that the conveyor directs bar 11 directly into the opening of first bar guide tube 22. Since there can be more than one bar along the conveyor, a plurality of bar guide tubes, or bar guide tube array 24 as seen in FIG. 2 can be provided. Illustrated in FIG. 2 are six openings for the entry of six bars into the device of this invention but more can be provided if desired as long as the bar guide tubes in the array are substantially parallel to one another. Each bar 11 leaves the front conveyor, passes into each bar guide tube 22 of bar guide tube array 24 and then passes into first chamber 38 within the device of this invention. The first chamber is formed by front wall 20 and central wall 42 within the device of this invention and has side walls which are disposed at angles forming a diamond shape as seen in FIG. 2. Along each side of the diamond-shaped casing as seen in FIG. 2 is disposed a shotblast machine such as the Blastec 24-inch diameter 3-inch wide blade wheel or equivalent. The blast machine utilized must have an extremely narrow blast pattern. The first blast machine 26 is disposed closer to front wall 20 just beyond the end of bar guide tube 22 and its blast pattern is approximately 4 inches wide. Its shot strikes against bar 11 as it passes thereunder. Second blast machine 28 is seen directing shot upwards against the opposite side wall 34. Second blast machine 28 is offset from first blast machine 26 being positioned closer to central wall 42 just inside the second bar guide tube 40 so that its shotblast pattern will not strike and otherwise cause damage to first blast machine 26. First and second shot blast machines 26 and 28 propel shot against the bar on its upper right side and lower left side and the bar respectively. Bar 11 is pushed into a second bar guide tube or series of bar guide tubes which correspond to bar guide tube array 24 and is in exact alignment therewith, the bar guide tube having a funnel-shaped opening somewhat wider than the opening of the rear of the bar guide tube to help direct the bar into the bar guide tube should there be any slight deflection of the bar. Bar 11 is then directed through second bar guide tube 40 within central wall 42 which divides first chamber 38 from the second chamber 44. The bar is moved therethrough by the pushing of front conveyor 70 into second chamber 44 where there is disposed third blast machine 48 on side wall 34 of the blast chamber. Third shotblast machine 48 propels shot downward against the upper left hand side of the bar, the third shotblast machine being disposed beyond the second bar guide tube 40 closer to the central wall 42. Also within second chamber 44 is disposed fourth shotblast machine 46, being positioned near rear wall 50, on wall 36 which propels shot upwards approximately 4 inches beyond the shot blast pattern of third shotblast machine 48 but still within the area not occupied by third bar guide tube 41 so that its blast pattern does not strike third shotblast machine 48. Fourth shotblast machine 46 will clean the lower right-hand portion of each bar as it passes thereby and helps lift the bar up to pass through third bar guide tube 41 which extends 6 inches inside and outside of rear wall 50 in aligment with the other two sets of bar guide tubes. The bar then passes out of the device of this invention to be picked up and carried by rear conveyor 72 which will eventually pull the bar out of the device of this invention once the rear end of bar 11 leaves front conveyor 70.

The use of a relatively short device with shotblast machines having narrow blast patterns allows the rebars or other cylindrical structures to be descaled without the necessity of having them carried as in the prior art within the shot machine by internal conveyor systems which are adversely affected by the shot. It should be noted that other long narrow objects can be cleaned such as axles and that the object cleaned does not necessarily have to be reinforcement bars but can be any elongated objects which can be passed in the above fashion through bar guide tubes.

One of the major reasons for the success of this device is the narrowness of its area of operation which allows for a first bar guide tube 22 of 12 inches in length to direct bar 11 to a 4-inch blast pattern with an air space defined before the bar encounters the blast pattern of the second shotblast machine. This air space allows the blast patterns not to interfere with one another. Second bar guide tube 40 can be approximately 12 inches in length disposed through central wall 42 and also has a 4-inch blast pattern from the third shotblast machine separated by approximately a 4-inch air space from the second 4-inch blast pattern from the fourth shotblast machine before the bar passes through the third bar guide tube to be carried out by the rear conveyor 72. The narrow blast patterns allow a minimum space of 12 inches between bar guide tubes which space is critical to the bar/bar guide tube entry, thus eliminating bar bending to prevent bar hang-up in the machine. The device can clean bars at a rate exceeding 50 ft. of bar per minute and the cleaned bars are then carried off for further processing such as powder-coating or electrostatic plastic coating which would prevent oxidation when they are installed for use. Other products cleaned, such as axles, can go on for further treatment which further treatment is not part of the device of this invention.

The system for recirculation of the shot incorporates a return auger mechanism 60 located at the bottom of the casing of the device which rotates moving the shot to a return system 58 where the shot is deposited on elevator system 62 where it is carried upwards by motors and directed to a shot reservoir 66 which then, through a series of return pipes 52 directs the shot back to the shotblast machines where the shot is quickly recirculated again. Other equivalent shot return methods can be utilized with the device of this invention.

Figure 5:
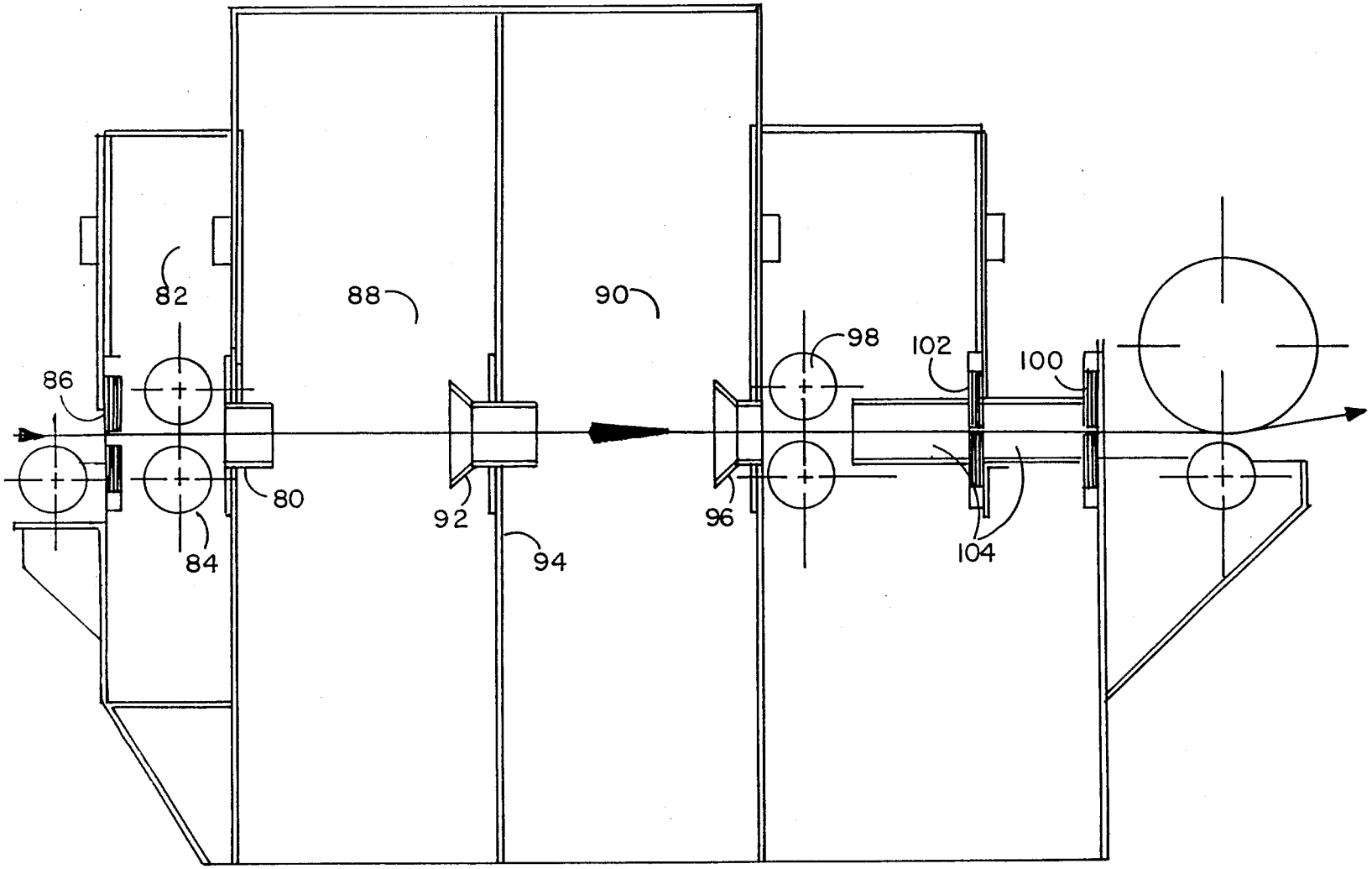
FIG. 5 is a cutaway view of FIG. 4 enlarged showing the interior of the chambers.
Figure 6:
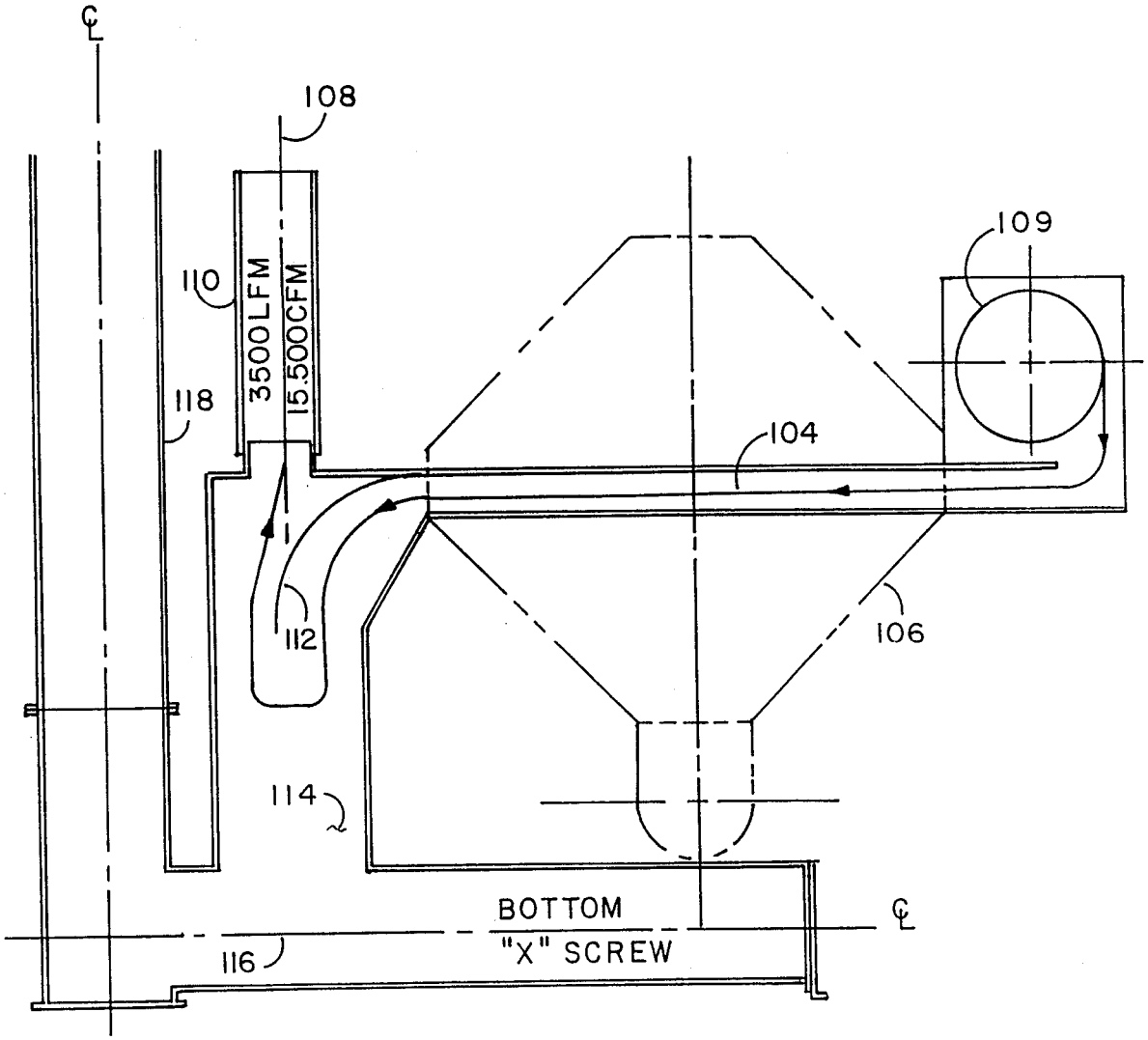
FIG. 6 is a cross-sectional view through a section of the cleaning chamber showing the suction and air blast machines used to clean the shot and debris from the top surface of the sheet steel.

When the device of this invention is to be used with sheet steel, a similar blast chamber is used with two chambers in the diamond-shaped casing having four blast wheels disposed therearound as described above but instead of individual guide tubes, an elongated sheet guide slot opening is provided for the sheet steel to pass into the device and through the chambers. In a typical example best seen in FIG. 5, the opening could be 5 feet in width and 5 inches in height. Because there is extra space between the opening and the steel, in order to limit the escape of shot through front opening 80, front vestibule 82 is provided which can contain before front opening 80, a pair of rollers 84 which help to guide the sheet steel. In the very front opening of vestibule 82 can be nylon brushes 86 located above and below the immediate surfaces of the sheet steel which brushes help retain the shot within the device. As in the bar device, the sheet steel passes through the narrow first chamber 88 with the shotblast wheels positioned as described above. The patterns, though, of the shotblast wheels can be arranged so that the entire surface of the steel is covered by the blast pattern of one wheel so that when passing through the first chamber the entire top and bottom of the sheet steel would be struck by the shotblast patterns of the first and second shotblast wheels and the same shotblast patterns would occur when the sheet metal entered second chamber 90. This full double striking helps to clean the steel more efficiently than steel being struck only by a series of short blast patterns requiring many wheels and a very long chamber as in the prior art. Similar to the bar guides above, sheet guide opening 92 is provided in mid-wall 94 between first chamber 88 and second chamber 90 and in a similar fashion a third sheet guide opening 96 is provided at the exit of second chamber 90. Rollers 98 can be used above and below the steel to help guide it as it passes into the rear vestibule where a further series of nylon brushes 100 and 102 help to sweep any shot and debris that may remain on top of the sheet steel and to retain shot in the casing. It should be noted that the shot will not remain on the bottom since it falls by gravity to the auger at the bottom of the steel sheet of the chamber as described above to be returned into the shot circulation system. In this embodiment to further clean shot and debris off the top of the steel, a cleaning chamber 104 is provided before the steel sheet exits from the device of this invention, and a cross-sectional view of such cleaning system can be seen in FIG. 6 whereby casing 106 can be seen in outline form and a blower 109 is provided to blow across the sheet steel that is passing therethrough. Such blast could be at a level of 8,000–10,000 or more linear feet per minute across the steel sheet. Cleaning chamber 104 can be approximately 1–6 inches in height and the steel sheet could be propelled therethrough at approximately 1 inch above the bottom of the chamber. At the other end of the cleaning chamber 104 is a suction apparatus which can be provided by dust collectors which are like large vacuum cleaners and are well known in the art. This suction device 108 can be disposed above pipe 110 and can provide a suction that is greater than the force of the air blowing from blower 109. In this way a high velocity air flow is created which removes the shot and debris from the surface to be cleaned. Shield 112 is provided to direct the shot and debris downward to an expansion chamber 114 where the shot, due to its heavier weight, falls down to auger 116 which directs it back to elevator 118 so that it is returned to the circulation chamber and redelivered to the blast wheels. In expansion chamber 114 while the shot is dropping to auger 116, the suction causes a turbulence and any debris or other dirt that has been removed from the sheet steel is sucked up suction pipe 110 to dust removal system 108, thus causing complete cleaning of the steel sheet and partial cleaning of the shot.

Figure 3:
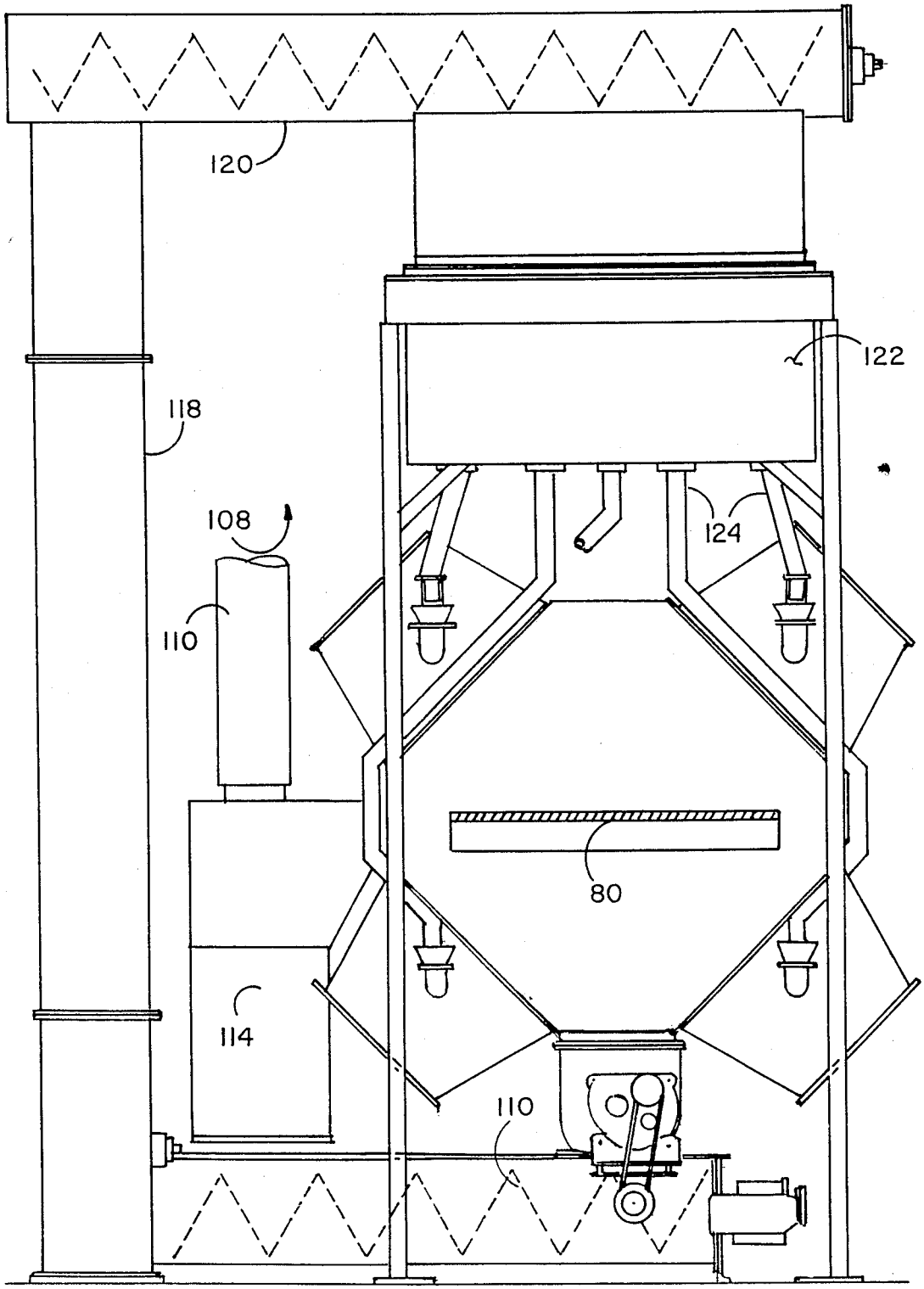

This same system is seen in FIG. 3 although not in cutaway section. In this view the casing can be seen with the shotblast wheels mounted therearound with expansion chamber 114 and return elevator 118 to upper auger 120 which delivers the shot to storage chamber 122 and back through pipes 124 to each individual shotblast machine.

Figure 4:
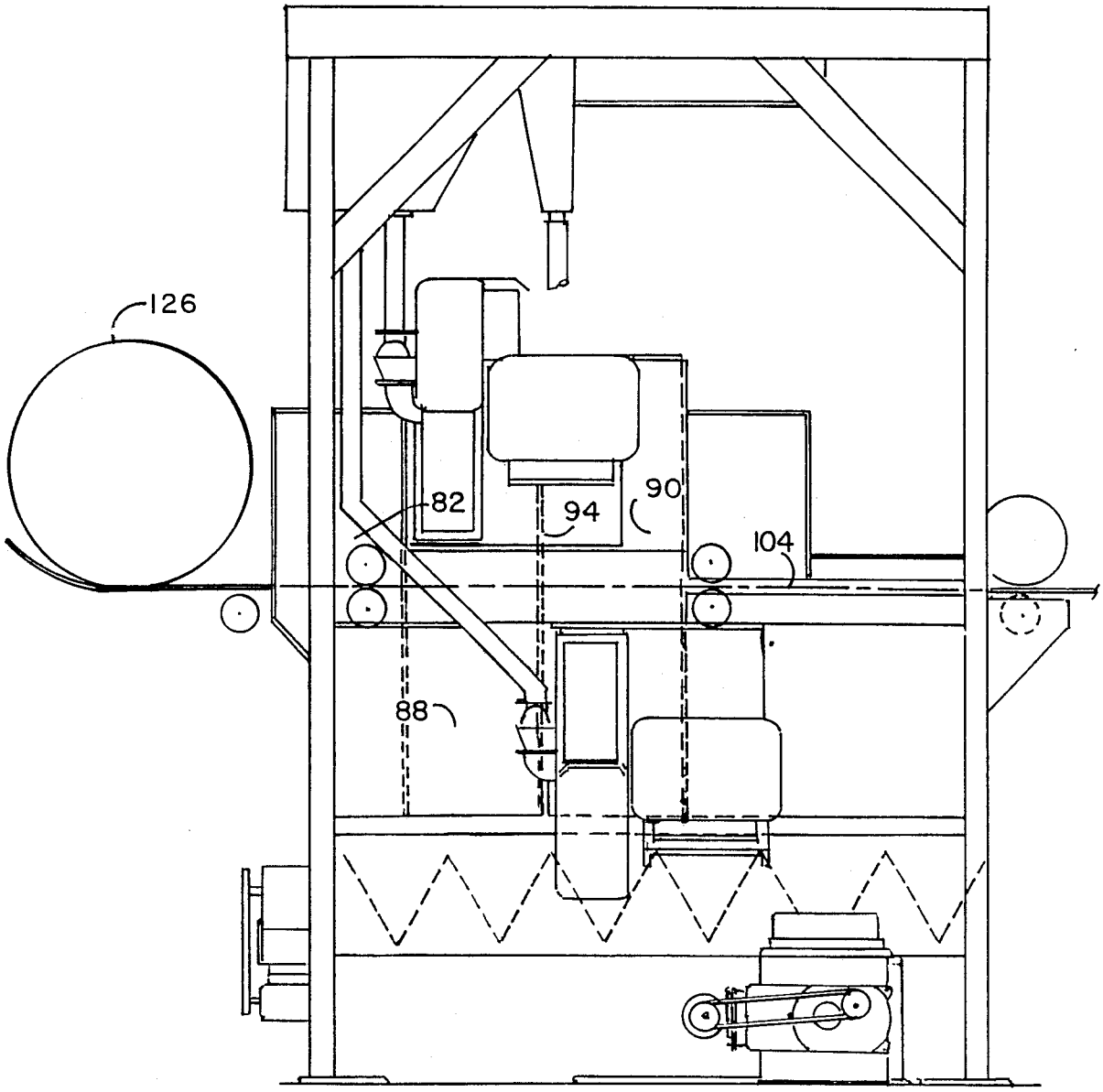
FIG. 4 is a side view of the embodiment of FIG. 3 showing the entrance of sheet steel therein and the arrangement of shotblast wheels on one side.

FIG. 4 illustrates a side exterior elevational view of the device showing the steel sheet coming around roller 126 and passing through front vestibule 82 into first chamber 88 and second chamber 90 around which are seen the shotblast wheels and their associated motors with delivery tubes of shot running thereto and the exit rear vestibule with cleaning chamber 104 seen to the rear. It should be noted that the advantage of this system is its extremely narrow configuration which takes up much less space in a factory than prior art chambers which must be placed within pits and can be 20 feet or more in length which size is a disadvantage. Dust collector 108 which is not illustrated herein is of well-known configuration and has bags to hold the debris which can be removed therefrom. One example of a commercial dust collector which could suffice is the Torit MTJ2800 automatic pulse air-cleaning dust collector with top bag removal. Other equivalent types of dust collectors could be used as long as they provided sufficient suction greater than the force of blower 109.

It should be noted that in the coil sheet steel cleaning machines it is expected that when descaling exterior surfaces of alloy steel sheet coils, the production of this unit would be at least 50 linear feet per minute.

Although the present invention has been described with reference to particular embodiments, it will be apparent to those skilled in the art that variations and modifications can be substituted therefor without departing from the principles and spirit of the invention.

I claim:

1. An elongated bar-shaped workpiece cleaning device where workpieces are moved lengthwise on a path through said device from front to rear with a front conveyor carrying said workpieces to said device and a rear conveyor carrying said workpieces away from the rear of said device, comprising:

a casing having a front wall, a rear wall and four sides disposed at 45 degree angles to said path of said workpieces, two of said sides being upper sides and two of said sides being lower sides a divider wall in said casing;

a first chamber, being approximately two feet in length, on one side of said divider wall between said divider wall and said front wall;

a second chamber, being approximately two feet in length, on the other side of said divider wall from said first chamber between said divider wall and said rear wall;

a first blast wheel to propel particles positioned on one of said upper side walls of said first chamber, said blast wheel having approximately a four-inch wide blast pattern;

a second blast wheel to propel particles positioned on an opposite lower side wall of said first chamber from said first blast wheel having approximately a four-inch wide blast pattern separated from said first blast wheel by an approximately four-inch wide air space defined therebetween, said first and second blast wheels mounted perpendicular to the direction of movement of said workpieces;

a third blast wheel to propel particles positioned on one of said upper side walls of said second chamber opposite from said wall in said first chamber having said first blast wheel said third blast wheel having approximately a four-inch wide blast pattern;

a fourth blast wheel to propel particles positioned on one os said lower side walls opposite said third blast wheel and on the opposite side wall of said second chamber from said side wall in said first chamber having said second blast wheel, said fourth blast wheel having approximately a four-inch wide blast pattern separated from said third blast wheel by an approximately four-inch wide air space defined therebetween and each of said third and fourth wheels mounted perpendicular to the direction of movement of said workpieces, the blast patterns of said first, second, third and fourth blast machines oriented perpendicular to the direction of movement of said workpieces;

a plurality of first bar guide tubes disposed in a horizontal parallel array in the front wall of said device, said bar guide tubes protruding approximately six inches into said first chamber, each of said bar guide tubes adapted to receive a workpiece to be cleaned therethrough, said first bar guide tubes adapted for said workpieces to be entered therein and pushed therethrough by said front conveyor, said particles to be propelled within said first chamber against said workpieces by said first and second blast wheels;

a plurality of second bar guide tubes each approximately twelve inches long disposed in a horizontal parallel array in said divider wall aligned with said first bar guide tubes, said second bar guide tubes extending from said divider wall approximately six inches into said first chamber and said second bar guide tubes extending from said divider wall approximately six inches into said second chamber through which said second bar guide tubes, said workpieces are passed into said second chamber where said workpieces have particles propelled thereagainst by said third and fourth blast wheels; and a plurality of third bar guide tubes disposed in a horizontal parallel array in the rear wall of said casing aligned with said second bar guide tubes, said third bar guide tubes extending approximately six inches into said second chamber, said first, second and third bar guide tubes all being positioned beyond the blast patterns of said first, second, third and fourth blast wheels in said first and second chambers, said workpieces adapted to be lifted by the force of said particles from said fourth blast wheel to assist in aligning it with and to pass through said third bar guide tubes and exit said casing onto said rear conveyor which pulls said workpieces out of said casing.

* * * * *